US009643228B2

(12) United States Patent
Libreiro et al.

(10) Patent No.: US 9,643,228 B2
(45) Date of Patent: May 9, 2017

(54) PANEL FLANGE BENDING TOOL

(71) Applicant: Carter Fabricating Inc., Brampton (CA)

(72) Inventors: Miguel Antonio Moore Libreiro, Ajax (CA); Joel Adam McKinley, Orangeville (CA)

(73) Assignee: CARTER FABRICATING INC., Brampton (CA)

( * ) Notice: Subject to any disclaimer, the term of this patent is extended or adjusted under 35 U.S.C. 154(b) by 0 days.

(21) Appl. No.: 14/878,521

(22) Filed: Oct. 8, 2015

(65) Prior Publication Data

US 2017/0100759 A1 Apr. 13, 2017

(51) Int. Cl.

| | |
|---|---|
| ***B21D 11/10*** | (2006.01) |
| ***B21D 39/02*** | (2006.01) |
| ***B21D 19/00*** | (2006.01) |

(52) U.S. Cl.

CPC ..... *B21D 11/10* (2013.01); *B21D 19/00* (2013.01); *B21D 39/021* (2013.01)

(58) Field of Classification Search

CPC ..... B21D 5/01; B21D 5/02; B21D 5/0209; B21D 11/10; B21D 11/20; B21D 19/082; B21D 19/10; B21F 1/002; B21F 29/00

USPC ..... 140/52, 123

See application file for complete search history.

(56) References Cited

U.S. PATENT DOCUMENTS

| | | | | |
|---|---|---|---|---|
| 2,539,461 | A | 1/1951 | Norquist | |
| 5,384,998 | A | 1/1995 | Tanaka et al. | |
| 6,035,598 | A | 3/2000 | Sukolics et al. | |
| 7,472,521 | B2 | 1/2009 | Bilge | |
| 8,127,507 | B1 | 3/2012 | Bilge | |
| 2009/0165527 | A1* | 7/2009 | Lechasseur | B21D 5/01 72/386 |

FOREIGN PATENT DOCUMENTS

| | | | | |
|---|---|---|---|---|
| FR | 374187 | A * | 6/1907 | B21D 11/10 |

* cited by examiner

*Primary Examiner* — Debra Sullivan
(74) *Attorney, Agent, or Firm* — Bereskin & Parr LLP

(57) ABSTRACT

A panel flange bending tool is disclosed, which includes a head coupled to an arm. The head includes a panel engaging portion, first and second bending corners, and an abutment. The panel engaging portion includes a flange slot having a slot plane extending in a proximal direction from a distal slot opening to a proximal slot end, the slot opening sized to receive a panel flange. The first bending corner is aligned with the flange slot, and the first and second bending corners define a first bending plane. The abutment extends proximal of the first and second bending corners. The second bending corner and the abutment define a second bending plane. The slot plane, the first bending plane, and the second bending plane intersect each other triangularly at first and second internal bending angles. The first and second internal bending angles are less than or equal to 90 degrees.

19 Claims, 8 Drawing Sheets

PANEL FLANGE BENDING TOOL

FIELD

This disclosure relates to the field of tools for bending flanges of panels.

INTRODUCTION

Panels, such as architectural panels for covering building walls, are sometimes bent about their periphery to form a panel flange for connection with a panel mounting system which secures the panels to the wall. The panel mounting system may dictate that the panel flange must be bent to a certain angle relative to the panel body (e.g. 90 degrees).

SUMMARY

In a first aspect, a panel flange bending tool is provided. The tool may comprise an arm, and a head coupled to the arm. The head may include a panel engaging portion, and an abutment. The panel engaging portion may include a flange slot and first and second bending corners. The flange slot may have a slot plane extending in a proximal direction from a distal slot opening to a proximal slot end. The slot opening may be sized to receive a panel flange. The first and second bending corners may be positioned on one side of the slot plane. The first bending corner may be aligned with the flange slot, and the first and second bending corners may define a first bending plane. The abutment may extend proximal of the first and second bending corners. The second bending corner and the abutment may define a second bending plane. The slot plane, the first bending plane, and the second bending plane may intersect each other triangularly. The slot plane and the first bending plane may intersect at a first internal bending angle, and the first and second bending planes may intersecting at a second internal bending angle. Each of the first and second internal bending angles may be less than or equal to 90 degrees, and at least one of the first and second internal bending angles may be less than 90 degrees.

In some embodiments, the first internal bending angle may be less than 90 degrees and the second bending corner may be positioned proximal the first bending corner.

In some embodiments, the first internal bending angle may be greater than 70 degrees and less than 90 degrees.

In some embodiments, the second internal bending angle may be greater than 70 degrees and less than 90 degrees.

In some embodiments, the panel engaging portion may comprise a lower slot wall spaced apart from an upper slot wall to define the flange slot.

In some embodiments, the upper slot wall may be coplanar with the slot plane.

In some embodiments, the first bending corner may be at a distal end of the upper slot wall.

In some embodiments, the flange slot may have a slot height of between 0.1 and 0.5 inches.

In some embodiments, the arm may be spaced apart from the second bending plane.

In some embodiments, the arm may extend from a first arm end to a second arm end, the head may be coupled to the first arm end, and the arm may extend away from the second bending plane toward the second arm end.

In some embodiments, the arm may extend from a first arm end to a second arm end, the head is coupled to the first arm end, and the tool may further comprise a handle coupled to the second arm end.

In some embodiments, the arm may be integrally formed with the head.

In some embodiments, the arm and the head may be extruded with constant cross-sectional profiles.

In another aspect, a method of bending a panel flange of a panel is provided. The panel flange may have first, second, and third flange portions. The method may comprise receiving the first flange portion in a panel engaging portion of a panel flange bending tool;

pivoting the bending tool in a pivot direction about a first bending corner of the bending tool until the first flange portion is rotated to a first internal bending angle of less than 90 degrees relative to the second flange portion;

pivoting the bending tool in the pivot direction about a second bending corner of the bending tool until the second flange portion is rotated to a second internal bending angle of less than 90 degrees relative to the third flange portion and an abutment of the bending tool contacts the panel; and removing the panel flange from the bending tool to permit elastic recovery to increase the first and second internal bending angles to approximately 90 degrees.

In some embodiments, the method may further comprise laying the panel flat on a surface, wherein said pivoting the bending tool in the pivot direction about the first bending corner may comprise rotating the first flange portion away from the surface while the first bending corner holds the second flange portion against the surface.

In some embodiments, said pivoting the bending tool in the pivot direction about the second bending corner may comprise rotating the second flange portion away from the surface while the second bending corner holds the third flange portion against the surface.

In some embodiments, the first internal bending angle may be greater than 70 degrees.

In some embodiments, the second internal bending angle may be greater than 70 degrees.

In some embodiments, said receiving may comprise inserting the first flange portion into a flange slot of the panel engaging portion.

In another aspect, a panel flange bending tool is provided. The tool may comprise an arm and a head coupled to the arm. The head may include a panel engaging portion for receiving a first flange portion of a panel flange, a first bending corner, a second bending corner, and a terminal abutment. The head may be pivotable about the first bending corner to rotate a first flange portion in the panel engaging portion until the panel flange contacts the second bending corner whereby the first flange portion forms a first internal bending angle of less than 90 degrees relative to the second flange portion, and the head may be pivotable about the second bending corner to rotate the second flange portion until the panel flange contacts the terminal abutment whereby the second flange portion forms a second internal bending angle of less than 90 degrees relative to a third flange portion.

DRAWINGS

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein and in the claims, a first element is said to be "received" in a second element where at least a portion of the first element is received in the second element unless specifically stated otherwise.

As used herein and in the claims, a first element is said to be "transverse" to a second element where the elements are oriented within 45 degrees of perpendicular to each other.

Figure 7:
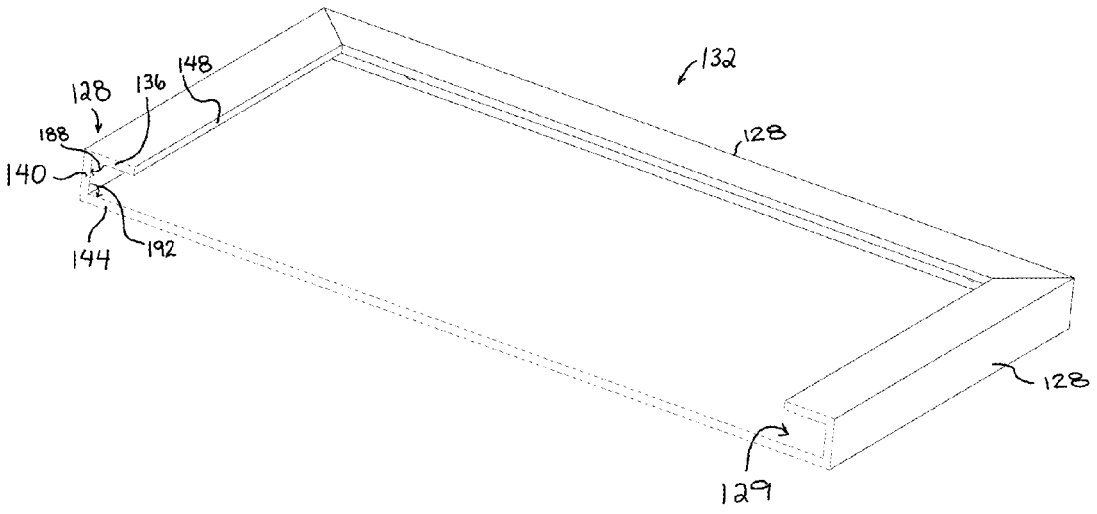
FIG. 7 is a section view of a panel.

A building may require dozens or even hundreds of architectural panels to cover its outside walls. Each panel may require a plurality of bent flanges to accommodate the panel mounting system used to fasten the panels to the building. For example, FIG. 7 shows a sectioned view of a panel 132 having panel flanges 128. As shown, each panel flange 128 may be bent in a U-shape as at 129. Accordingly, a tool for rapidly and consistently forming panel flanges to the specification of the panel mounting system would be desirable.

Panel 132 may be made of any suitable material(s). For example, panel 132 may be made of one or more of metal, an elastomer (e.g. rubber), and plastic. In some embodiments, panel 132 is an aluminum composite panel (ACM) which includes a plastic (e.g. polyethylene) core between outer layers of aluminum. In some embodiments, panel 132 may be less than 0.5 inches thick, such as between 0.1 and 0.5 inches thick.

Figure 1:
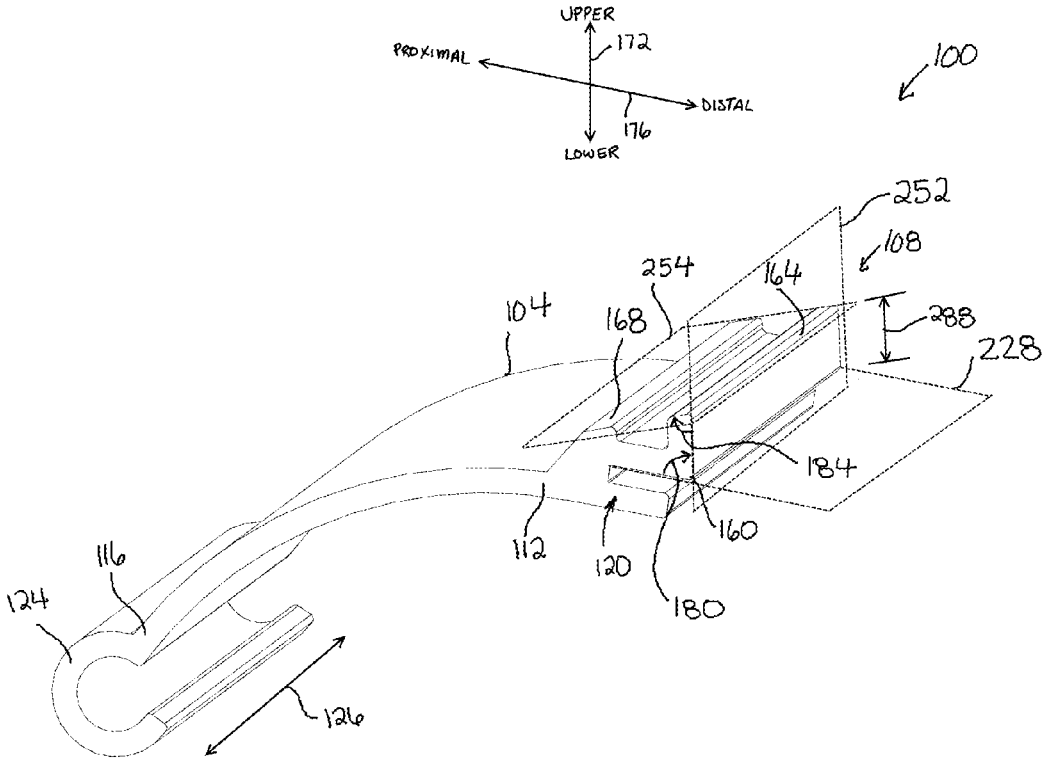
FIG. 1 is a perspective view of a panel flange bending tool in accordance with at least one embodiment.

Referring to FIGS. 1 and 7, a panel flange bending tool 100 (FIG. 1) is shown in accordance with at least one embodiment. As shown, panel flange bending tool 100 includes an arm 104 and a head 108. Arm 104 extends from a first arm end 112 to a second arm end 116. Head 108 may be coupled to first arm end 112, and may include a panel engaging portion 120 sized and configured to receive a panel flange 128. A user or mechanical device may manipulate arm 104 to pivot head 108 for bending the panel flange 128. In some embodiments, a handle 124 may be connected to second arm end 116 for manual manipulation (i.e. by hand) of arm 104. For example, a user may manually grasp handle 124 to move arm 104 for pivoting head 108 to bend the panel flange 128. In some embodiments, tool 100 does not include handle 124. As used herein and in the claims, a "panel flange" is a section of a panel that may be or has been bent by flange bending tool 100 to form a finished U-shaped flange.

Head 108 may be connected to first arm end 112 in any suitable fashion. For example, head 108 may be connected to first arm end 112 by mechanical fasteners (e.g. screws, bolts, nails, or rivets), welds, adhesives, or by integrally forming head 108 and first arm end 112. Similarly, handle 124 may be connected to second arm end 116 in any suitable fashion. For example, handle 124 may be connected to second arm end 116 by mechanical fasteners (e.g. screws, bolts, nails, or rivets), welds, adhesives, or by integrally forming head 108 and second arm end 116. In the illustrated example, head 108 and handle 124 are integrally formed with arm 104. For example, arm 104 and head 108 (and handle 124 if present) may be integrally formed by extrusion. This may provide arm 104, head 108, (and handle 124 if present) with constant cross-sectional profiles across their extruded depth 126.

Panel-flange bending tool 100 may be made of any suitable material(s). Each of arm 104, head 108, and handle 124 (if present) may be made of the same or different materials. For example, arm 104, head 108, and handle 124 may be made of a rigid material such as metal, ceramic, or hard plastics. In some embodiments, one or more of arm 104, head 108, and handle 124 is formed by extrusion, and therefore made of a material suitable for extrusion (e.g. metal). In some embodiments, the material of one or more of arm 104, head 108, and handle 124 is between 0.1 and 0.5 inches thick.

Figure 2:
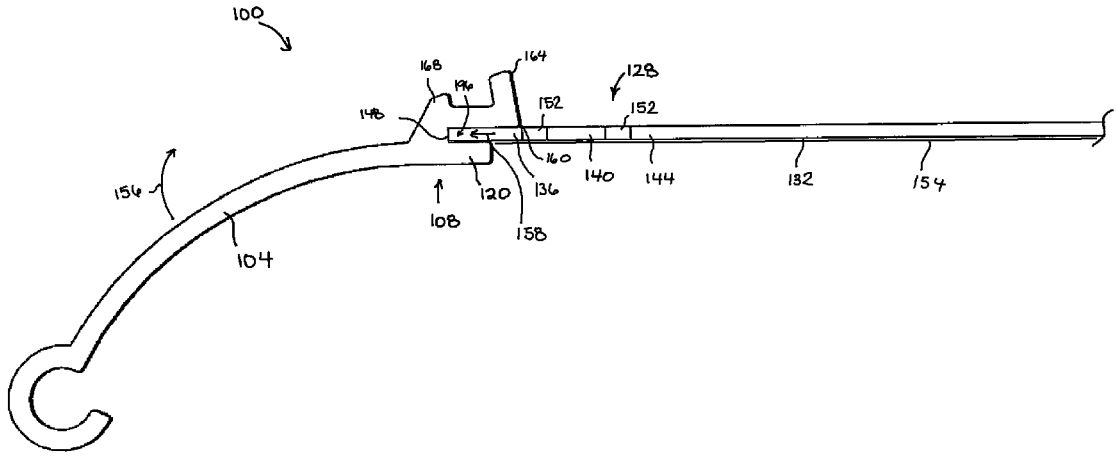
FIG. 2 is side elevation view of the panel flange bending tool of FIG. 1 in a first position having received a first panel flange portion.
Figure 3:
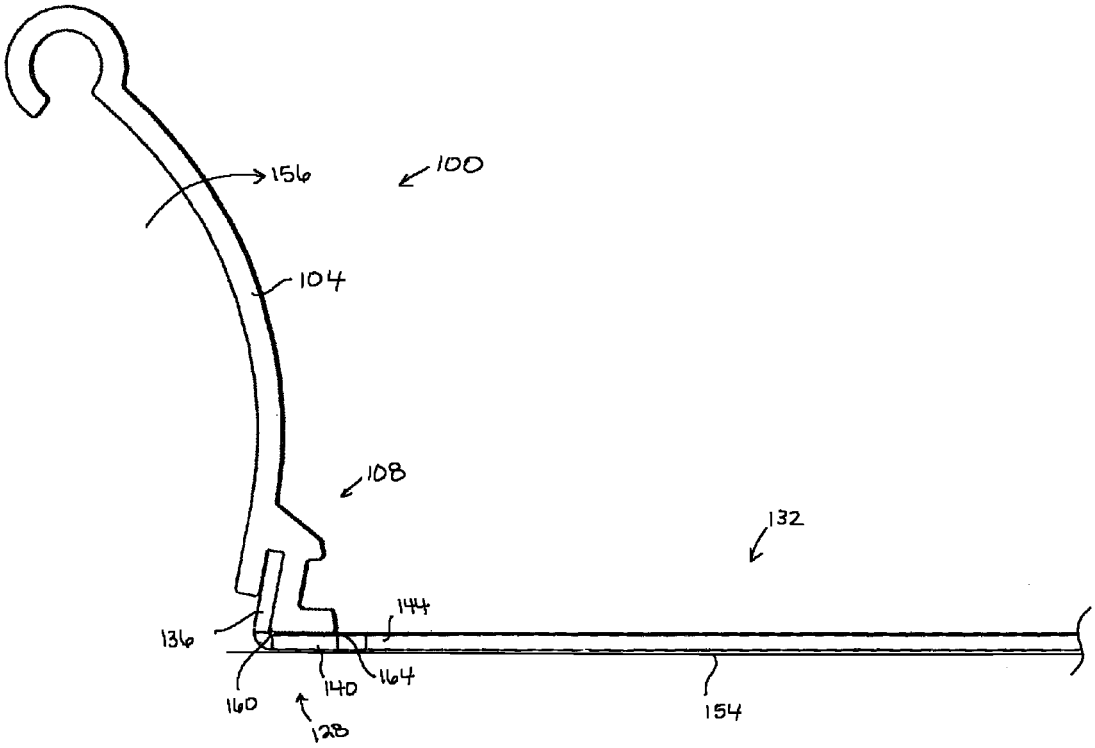
FIG. 3 is a side elevation view of the panel flange bending tool of FIG. 1 in a second position having rotated the first panel flange portion.
Figure 4:
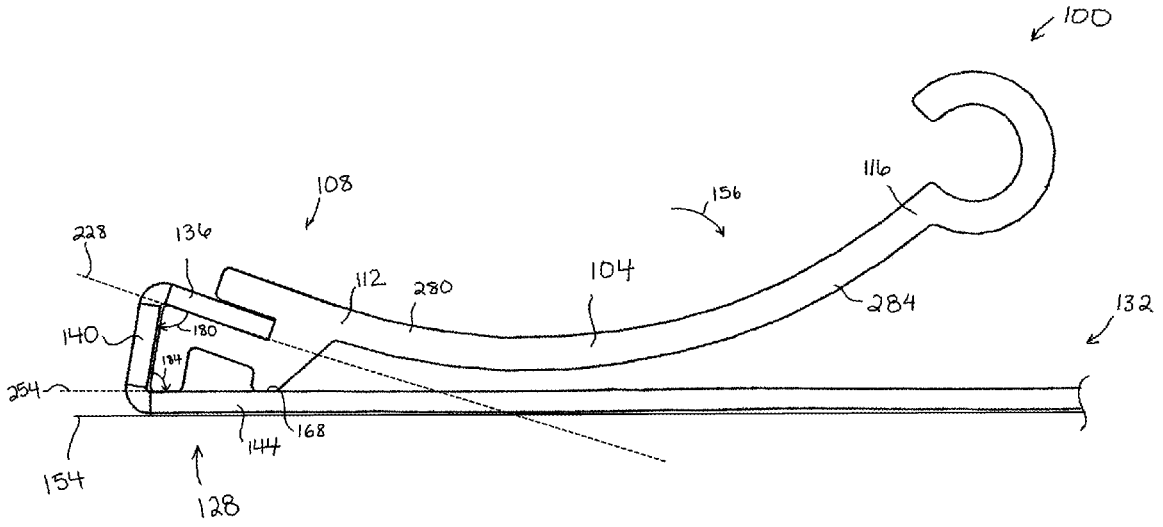
FIG. 4 is a side elevation view of the panel flange bending tool of FIG. 1 in a third position having rotated a second panel flange portion.

FIGS. 2-4 show steps in a method of bending a flange 128 of a panel 132. Turning to FIG. 2, panel flange 128 is shown including first, second, and third portions 136, 140, and 144. As shown, first panel flange portion 136 may extend inwardly from panel free edge 148, second panel flange portion 140 may extend inwardly of first panel flange portion 136, and third panel flange portion 144 may extend inwardly of second panel flange portion 140.

As used herein and in the claims, a first element is said to "extend inwardly of" a second element where at least a portion of the first element is positioned inwardly of the second element. For example, the elements may be joined at a threshold between the elements, the elements may overlap, or the elements may be spaced apart.

Panel flange portions 136, 140, and 144 may be connected together in any suitable manner. For example, panel flange portions 136, 140, and 144 may be directly connected so that second panel flange portion 140 extends from first panel flange portion 136 to third panel flange portion 144. Alternatively, adjacent panel flange portions 136 and 140, or 140 and 144 may be spaced apart and connected by intermediary panel flange portions 152 as shown. In some embodiments, intermediary panel flange portions 152 may bend preferentially to panel flange portions 136, 140, and 144 as panel flange 128 is bent by panel flange bending tool 100. For example, intermediary panel flange portions 152 may be formed or machined to have a narrower thickness to accommodate bending.

Figure 5:
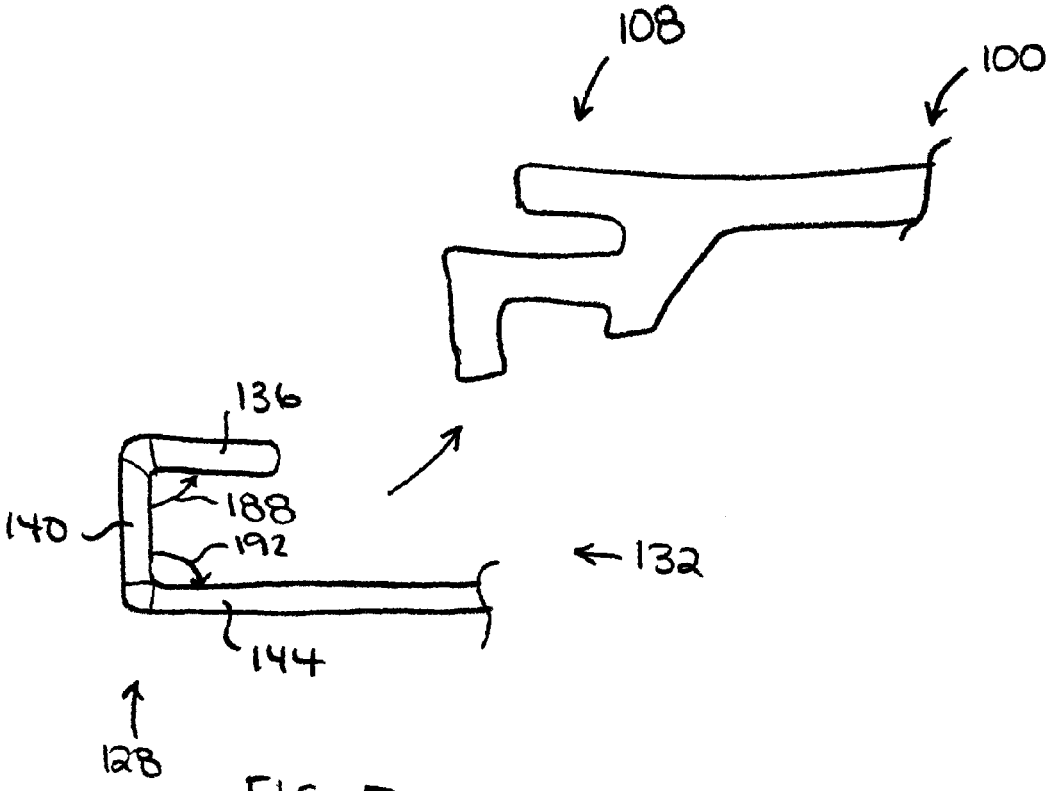
FIG. 5 is a partial side elevation view of the panel flange bending tool of FIG. 1 disengaged from the panel flange after bending.

As shown in FIG. 2, panel engaging portion 120 of head 108 may be sized to receive first panel flange portion 136. With panel 132 lying flat on a surface 154 (e.g. table), panel flange bending tool 100 may be rotated in direction 156 about head 108 through the positions shown in FIGS. 2-4 and then disengaged from panel 132 to permit panel flange portions 136, 140, and 144 to spring back under elastic recovery as shown in FIG. 5. Accordingly, panel flange bending tool 100 may be configured to over-bend the panel flange 128 according to the expected elastic recovery to achieve the desired final flange profile.

Referring now to FIG. 2, head 108 may include a panel engaging portion 120 for holding panel flange 128 during bending, first and second bending corners 160 and 164 for defining the positions of bends to be formed in panel flange 128, and a terminal abutment 168 for defining the bending limit of tool 100. Turning to FIG. 4, when panel-flange bending tool 100 is rotated in direction 156 to the bending limit defined by terminal abutment 168, a first internal bending angle 180 is formed between first and second panel flange portions 136 and 140, and a second internal bending angle 184 is formed between second and third panel flange portions 140 and 144.

In some embodiments, panel flange 128 is formed from a material that exhibits non-trivial elastic recovery after bending. For example, some materials have non-trivial bending strain at the material yield strength which reverses when the bending stress returns to zero. Accordingly, panel-flange bending tool 100 may be configured to bend panel flange 128 beyond a desired final condition of panel flange 128. For example, FIG. 4B illustrates bending panel flange 128 to form acute first and second internal bending angles 180 and 184, and FIG. 5 illustrates the corresponding first and second internal final angles 188 and 192 which have increased by material elasticity to approximately 90 degrees after panel flange 128 is released from tool 100.

Figure 4B:
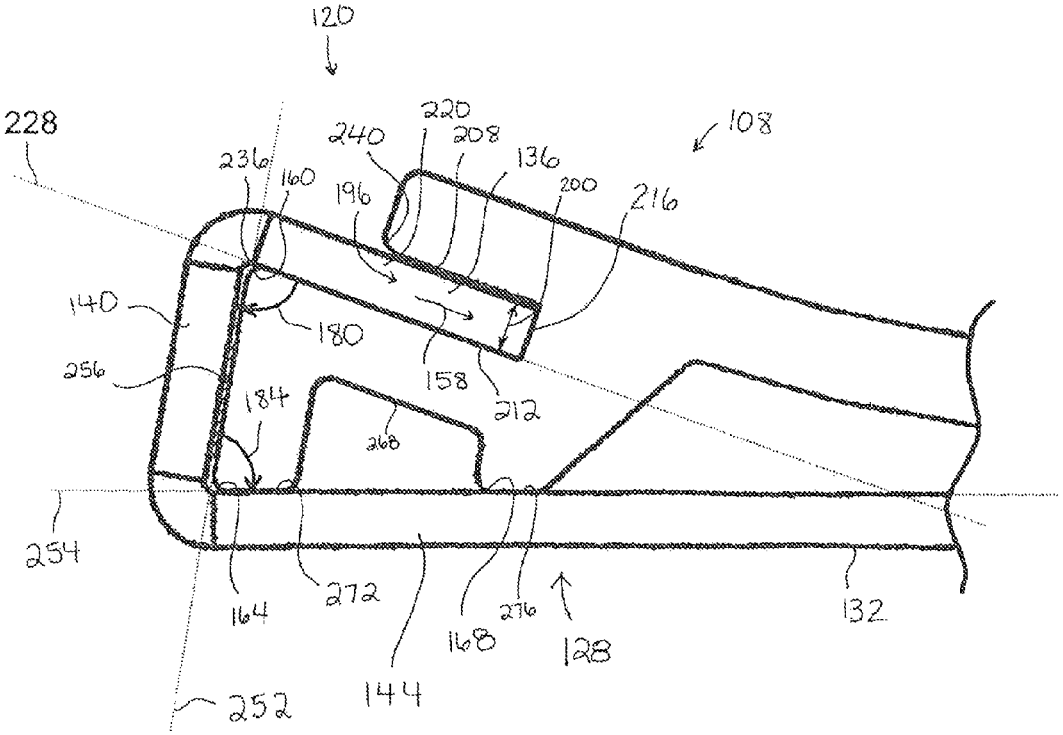
FIG. 4B is an enlarged partial view of the panel flange bending tool of FIG. 1 in the third position.

Referring to FIGS. 4B and 5, internal bending angles 180 and 184 may be selected according to desired internal final angles 188 and 192 and the elastic recovery properties of the panel flange material. For example, where the desired internal final angles 188 and 192 are 90 degrees, the internal bending angles 180 and 184 may be acute angles between 50 and 90 degrees (exclusive) or between 70 and 90 degrees (exclusive). Accordingly, panel-flange bending tool 100 may be specially purposed for consistently and repeatedly bending panel flanges 128 of a particular material to specific internal final angles 188 and 192. This may permit a plurality of identically bent panels 132 to be quickly and consistently formed taking into account the elastic properties of the panel material.

Still referring to FIG. 4B, panel engaging portion 120 may take any suitable form for holding first panel flange portion 136 during bending. As shown, panel engaging portion 120 may be suitably configured to receive first panel flange portion 136 inserted in the proximal direction 158. In the illustrated example, panel engaging portion 120 includes a flange slot 196 sized to receive first panel flange portion 136. For example, flange slot 196 may extend distally from a proximal slot end 216 to a distal slot opening 220 sized to permit first panel flange portion 136 to pass. As shown, panel engaging portion 120 may include a lower slot wall 208 spaced apart from an upper slot wall 212 by a slot height 200 to define flange slot 196. In some embodiments, slot height 200 may be less than 0.5 inches, such as between 0.1 and 0.5 inches.

Turning to FIG. 1, head 108 includes a vertical axis 172, along which elements may be relatively "upper" or "lower", and a lateral axis 176 along which elements may be relatively "proximal" or "distal". The vertical axis 172 is transverse to the lateral axis 176 as shown.

Figure 6B:
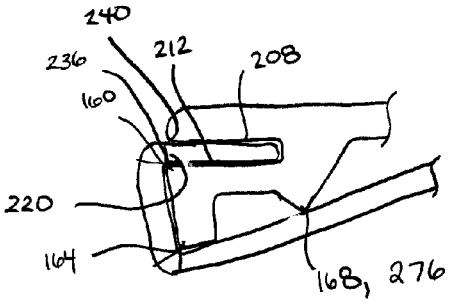
FIGS. 6A-6C are partial side elevation views of panel flange bending tool heads in accordance with other embodiments.
Figure 6A:
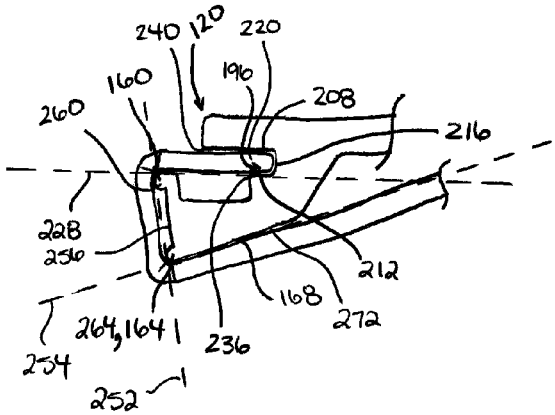

Returning to FIG. 4B, flange slot 196 may have any suitable orientation. In the illustrated embodiment, flange slot 196 has a slot plane 228 which extends in the proximal direction 158 from distal slot opening 220 to proximal slot end 216. As shown, upper slot wall 212 may be coplanar with slot plane 228. Lower and upper slot walls 208 and 212 may take any suitable configuration. For example, a distal end 236 of upper slot wall 212 may be distal to a distal end 240 of lower slot wall 208 as shown in FIG. 4. Alternatively, the distal ends 236 and 240 of upper and lower slot walls 212 and 208 may be aligned as shown in FIG. 6B. In a further alternative, the distal end 240 of lower slot wall 208 may be distal to the distal end 236 of upper slot wall 212 as shown in FIG. 6A.

First and second bending corners 160 and 164 may take any suitable form. FIG. 4B illustrates an embodiment where first bending corner 160 is a juncture between upper slot wall 212 and head distal wall 256, and where second bending corner 164 is a juncture between head distal wall 256 and head upper wall 272. In alternative embodiment, FIG. 6A shows an embodiment where first and second bending corners 160 and 164 are formed as distal protrusions 260 and 264 from head distal wall 256. Bending corners 160 and 164 may be formed as rounded edges as shown, or sharp corners.

First bending corner 160 may be positioned at any suitable location relative to panel engaging portion 120. In some embodiments, first bending corner 160 may be positioned aligned with flange slot 196. For example, first bending corner 160 may be positioned at slot opening 220 as shown in FIG. 6B, or outboard of slot opening 220 as shown in FIGS. 4B and 6A.

Referring again to FIG. 4B, first and second bending corners 160 and 164 together define a first bending plane 252. As used herein and in the claims, a "bending plane" is a planar extent connecting at least two points on head 108 uninterrupted. That is, there are no protrusions of head 108 which extend through the bending plane. Accordingly, a panel flange 128 bending around first and second bending corners 160 and 164 may extend coplanar with first bending plane 252 between the bending corners 160 and 164. Thus, first bending plane 252 defines the orientation of second panel flange portion 140 when panel flange 128 is engaged with and bent by panel-flange bending tool 100.

Still referring to FIG. 4B, second bending corner 164 and terminal abutment 168 together define a second bending plane 254. Here again, the panel flange 128 while bending around second bending corner 164 to terminal abutment 168 may extend coplanar with second bending plane 254 between second bending corner 164 and terminal abutment 168. Thus, second bending plane 254 defines the orientation of third panel flange portion 144 when panel flange 128 is engaged with and bent by panel-flange bending tool 100.

Figure 6C:
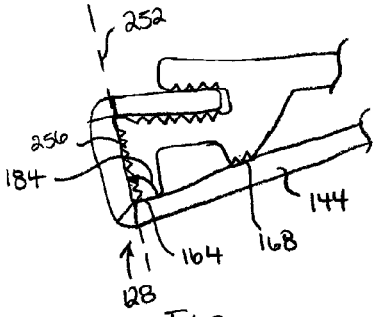

In some embodiments, a bending plane may be coplanar with a wall of head 108. For example, the illustrated embodiment shows head distal wall 256 extending coplanar with first bending plane 252. In alternative embodiment, portions of a bending plane may be separated from head 108 between contact points. For example, head upper wall 272 may include a recess 268 between second bending corner 164 and terminal abutment 168 where head upper wall 272 is spaced apart from second bending plane 254. FIG. 6A shows an embodiment where bending corners 160 and 164 are formed by discrete protrusions 260 and 264 of head distal wall 256, and head distal wall 256 is spaced apart from first bending plane 252 between protrusions 260 and 264. FIG. 6C shows an embodiment where head distal wall 256 is corrugated and therefore intermittently contacts first bending plane 252.

Terminal abutment 168 may take any form suitable for impeding bending about second bending corner 164 beyond a threshold bending limit (as defined by second internal bending angle 184). For example, terminal abutment 168 may contact third panel flange portion 144 when panel flange 128 is bent about second bending corner 164 to the threshold bending limit. FIG. 4B shows an embodiment where terminal abutment 168 is formed as a proximal portion 276 of head upper wall 272 delimited by recess 268. Proximal portion 276 may be planar as shown, or pointed as in FIG. 6B for example. FIG. 6C shows an alternative embodiment where terminal abutment 168 is corrugated to form several points of intermittent contact with third panel flange 144 when bent to the threshold bending limit. FIG. 6A shows an alternative embodiment where terminal abutment 168 is defined by the entire planar extent of upper wall 272.

Referring to FIG. 1, two or more of the slot plane 228, the first bending plane 252, and the second bending plane 254 may intersect. As shown, the slot plane 228 and the first bending plane 252 may intersect at the first internal bending angle 180 of 90 degrees or less, and the first and second bending planes 252 and 254 may intersect at the second internal bending angle 184 of 90 degrees or less. Where at least one of the first and second internal bending angles 180 is less than 90 degrees, the slot plane 228, the first bending plane 252, and the second bending plane 254 may intersect triangularly. That is, the slot plane 228 may further intersect the second bending plane 254.

As shown, first and second bending corners 160 and 164 are positioned inside the triangular arrangement of the slot plane 228, the first bending plane 252, and the second bending plane 254. That is, the first and second bending corners 160 and 164 are both positioned on one side of the slot plane 228, on one side of the first bending plane 252, and on one side of the second bending plane 254. Consequently, none of the slot plane 228, the first bending plane 252, or the second bending plane 254 is interposed between the first bending corner 160 and the second bending corner 164. As used herein and in the claims, "on one side" of a plane means on the plane or spaced apart from the plane in the normal direction of that side.

Still referring to FIG. 1, second bending corner 164 may be positioned above first bending corner 160. For example, second bending corner 164 may be spaced apart from first bending corner 160 by a distance 288. In some embodiments, distance 288 may be less than 1 inch, such as between 0.5 inches and 0.85 inches. In some embodiments, second bending corner 164 may be positioned proximally of first bending corner 160 (e.g. where first internal bending angle 180 is less than 90 degrees). As shown, terminal abutment 168 extends proximal of first and second bending corners 160 and 164. As used herein and in the claims, a first element is said to "extend proximal of" a second element where at least a portion of the first element is positioned proximal of the second element. For example, FIGS. 1, 6B, and 6C illustrate that terminal abutment 168 may be spaced apart from second bending corner 164, and FIG. 6A illustrates that terminal abutment 168 may extend from second bending corner 164.

In use, first panel flange portion 136 may be inserted in proximal direction 158 into flange slot 196 as shown in FIG. 2 with panel 132 supported flat on a surface 154. Next, arm 104 may be manipulated to pivot head 108 in bending direction 156 about first bending corner 160 to rotate first panel flange portion 136 relative to second and third panel flange portions 140 and 144 as shown in FIG. 3. As shown, first bending corner 160 may hold the remainder of panel 132 flat against surface 154 while first panel flange portion 136 is rotated away from the surface 154. Finally, arm 104 may be further manipulated to pivot head 108 in pivot direction 156 about second bending corner 164 to rotate first and second panel flange portions 136 and 140 relative to third panel flange portion 144 until terminal abutment 168 contacts panel 132 as shown in FIG. 4. As shown, second bending corner 164 may hold the remainder of panel 132 flat against surface 154 while the second panel flange portion 140 is rotated away from the surface 154.

Referring to FIG. 4, arm 104 may be shaped to clear panel 132 when panel flange 128 is bent to the point that terminal abutment 168 contacts panel 132. For example, arm 104 may be wholly positioned on the same side of second bending plane 254 as panel engaging portion 120 and first bending corner 160. As shown, arm 104 may be wholly spaced apart from second bending plane 254.

In the illustrated example, arm 104 includes a first arm portion 280 and a second arm portion 284. First arm portion 280 may be positioned proximate first arm end 112. For example, first arm portion 280 may extend from first arm end 112. Second arm portion 284 may be positioned proximate second arm end 116. For example, second arm portion 284 may extend from second arm end 116. As shown, first arm portion 280 may extend away from head 108 toward second bending plane 254, and second arm portion 284 may away from first arm portion 280 away from second bending plane 254. For example, first arm portion 280 may extend approximately parallel to slot plane 228, and second arm portion 284 may extend downwardly away from second bending plane 254.

In some embodiments, arm 104 may transition gradually from first arm portion 280 to second arm portion 284 with a wide bend as shown. For example, arm 104 may have bend radii of between 3 to 5 inches. In alternative embodiments, first and second arm portions 280 and 284 may be straight (i.e. uncurved) segments which meet at a sharp corner.

In alternative embodiments, the entirety of arm 104 extends parallel to or away from second bending plane 254 instead of bending toward and away from second bending plane 254 as shown.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1. A panel flange bending tool comprising:

an arm; and a head coupled to the arm, the head including a panel engaging portion including a flange slot, the flange slot having a slot plane extending in a proximal direction from a distal slot opening to a proximal slot end, the slot opening sized to receive a panel flange;

first and second bending corners on one side of the slot plane, the first bending corner aligned with the flange slot, and the first and second bending corners defining a first bending plane;

an abutment extending proximal of the first and second bending corners, the second bending corner and the abutment defining a second bending plane, the slot plane, the first bending plane, and the second bending plane intersecting each other triangularly, the slot plane and the first bending plane intersecting at a first internal bending angle, and the first and second bending planes intersecting at a second internal bending angle, each of the first and second internal bending angles is less than or equal to 90 degrees, and at least one of the first and second internal bending angles is less than 90 degrees.

Item 2. The panel flange bending tool of item 1, wherein:

the first internal bending angle is less than 90 degrees and the second bending corner is positioned proximal the first bending corner.

Item 3. The panel flange bending tool of any one of items 1-2, wherein:

the first internal bending angle is greater than 70 degrees and less than 90 degrees.

Item 4. The panel flange bending tool of any one of items 1-3, wherein:

the second internal bending angle is greater than 70 degrees and less than 90 degrees.

Item 5. The panel flange bending tool of any one of items 1-4, wherein:

the panel engaging portion comprises a lower slot wall spaced apart from an upper slot wall to define the flange slot.

Item 6. The panel flange bending tool of item 5, wherein:

the upper slot wall is coplanar with the slot plane.

Item 7. The panel flange bending tool of any one of items 5-6, wherein:

the first bending corner is at a distal end of the upper slot wall.

Item 8. The panel flange bending tool of any one of items 1-7, wherein:

the flange slot has a slot height of between 0.1 and 0.5 inches.

Item 9. The panel flange bending tool of any one of items 1-8, wherein:

the arm is spaced apart from the second bending plane.

Item 10. The panel flange bending tool of any one of items 1-9, wherein:

the arm extends from a first arm end to a second arm end, the head is coupled to the first arm end, and the arm extends away from the second bending plane toward the second arm end.

Item 11. The panel flange bending tool of any one of items 1-10, further comprising:

the arm extends from a first arm end to a second arm end, the head is coupled to the first arm end, and a handle coupled to the second arm end.

Item 12. The panel flange bending tool of any one of items 1-11, wherein:

the arm is integrally formed with the head.

Item 13. The panel flange bending tool of item 12, wherein:

the arm and the head are extruded with constant cross-sectional profiles.

Item 14. A method of bending a panel flange of a panel, the panel flange having first, second, and third flange portions, the method comprising:

receiving the first flange portion in a panel engaging portion of a panel flange bending tool;

pivoting the bending tool in a pivot direction about a first bending corner of the bending tool until the first flange portion is rotated to a first internal bending angle of less than 90 degrees relative to the second flange portion;

pivoting the bending tool in the pivot direction about a second bending corner of the bending tool until the second flange portion is rotated to a second internal bending angle of less than 90 degrees relative to the third flange portion and an abutment of the bending tool contacts the panel; and removing the panel flange from the bending tool to permit elastic recovery to increase the first and second internal bending angles to approximately 90 degrees.

Item 15. The method of item 14, further comprising:

laying the panel flat on a surface;

wherein said pivoting the bending tool in the pivot direction about the first bending corner comprises rotating the first flange portion away from the surface while the first bending corner holds the second flange portion against the surface.

Item 16. The method of item 15, wherein:

said pivoting the bending tool in the pivot direction about the second bending corner comprises rotating the second flange portion away from the surface while the second bending corner holds the third flange portion against the surface.

Item 17. The panel flange bending tool of any one of items 14-16, wherein:

the first internal bending angle is greater than 70 degrees.

Item 18. The panel flange bending tool of any one of items 14-17, wherein:

the second internal bending angle is greater than 70 degrees.

Item 19. The panel flange bending tool of any one of items 14-18, wherein:

said receiving comprises inserting the first flange portion into a flange slot of the panel engaging portion.

Item 20. A panel flange bending tool comprising:

an arm; and a head coupled to the arm, the head including a panel engaging portion for receiving a first flange portion of a panel flange;

a first bending corner, a second bending corner, and a terminal abutment, the head pivotable about the first bending corner to rotate a first flange portion in the panel engaging portion until the panel flange contacts the second bending corner whereby the first flange portion forms a first internal bending angle of less than 90 degrees relative to the second flange portion, and the head pivotable about the second bending corner to rotate the second flange portion until the panel flange contacts the terminal abutment whereby the second flange portion forms a second internal bending angle of less than 90 degrees relative to a third flange portion.

The invention claimed is:

1. A panel flange bending tool comprising:

an arm; and a head coupled to the arm, the head including a panel engaging portion including a flange slot, the flange slot having a slot plane extending in a proximal direction from a distal slot opening to a proximal slot end, the slot opening sized to receive a panel flange;

first and second bending corners on one side of the slot plane, the first bending corner aligned with the flange slot, and the first and second bending corners defining a first bending plane;

an abutment positioned proximal of the first and second bending corners, the second bending corner and the abutment defining a second bending plane, the slot plane, the first bending plane, and the second bending plane intersecting each other as a triangle surrounding the first and second bending corners, the slot plane and the first bending plane intersecting at a first internal bending angle, and the first and second bending planes intersecting at a second internal bending angle, each of the first and second internal bending angles is less than or equal to 90 degrees, and at least one of the first and second internal bending angles is less than 90 degrees.

2. The panel flange bending tool of claim 1, wherein:

the first internal bending angle is less than 90 degrees and the second bending corner is positioned proximal the first bending corner.

3. The panel flange bending tool of claim 1, wherein:

the first internal bending angle is greater than 70 degrees and less than 90 degrees.

4. The panel flange bending tool of claim 3, wherein:

the second internal bending angle is greater than 70 degrees and less than 90 degrees.

5. The panel flange bending tool of claim 1, wherein:

the panel engaging portion comprises a lower slot wall spaced apart from an upper slot wall to define the flange slot.

6. The panel flange bending tool of claim 5, wherein:

the upper slot wall is coplanar with the slot plane.

7. The panel flange bending tool of claim 5, wherein:

the first bending corner is at a distal end of the upper slot wall.

8. The panel flange bending tool of claim 1, wherein:

the flange slot has a slot height of between 0.1 and 0.5 inches.

9. The panel flange bending tool of claim 1, wherein:

the arm is spaced apart from the second bending plane.

10. The panel flange bending tool of claim 1, wherein:

the arm extends from a first arm end to a second arm end, the head is coupled to the first arm end, and the arm extends away from the second bending plane toward the second arm end.

11. The panel flange bending tool of claim 1, further comprising:

the arm extends from a first arm end to a second arm end, the head is coupled to the first arm end, and a handle coupled to the second arm end.

12. The panel flange bending tool of claim 1, wherein:

the arm is integrally formed with the head.

13. The panel flange bending tool of claim 12, wherein:

the arm and the head are extruded with constant cross-sectional profiles.

14. A method of forming a panel flange from first, second, and third flange portions of a panel using a panel flange bending tool, the bending tool comprising a head defining a panel engaging portion, first and second bending corners, and an abutment, the method comprising:

receiving the first flange portion in the panel engaging portion of the bending tool;

pivoting the bending tool in a pivot direction about the first bending corner of the bending tool until the first flange portion is rotated to a first internal bending angle of less than 90 degrees relative to the second flange portion;

pivoting the bending tool in the pivot direction about the second bending corner of the bending tool until the second flange portion is rotated to a second internal bending angle of less than 90 degrees relative to the third flange portion and the abutment of the bending tool contacts the panel; and removing the panel flange from the bending tool to permit elastic recovery to increase the first and second internal bending angles to approximately 90 degrees.

15. The method of claim 14, further comprising:

laying the panel flat on a surface;

wherein said pivoting the bending tool in the pivot direction about the first bending corner comprises rotating the first flange portion away from the surface while the first bending corner holds the second flange portion against the surface.

16. The method of claim 15, wherein:

said pivoting the bending tool in the pivot direction about the second bending corner comprises rotating the second flange portion away from the surface while the second bending corner holds the third flange portion against the surface.

17. The method of claim 14, wherein:

the first internal bending angle is greater than 70 degrees.

18. The method of claim 17, wherein:

the second internal bending angle is greater than 70 degrees.

19. The method of claim 14, wherein:

said receiving comprises inserting the first flange portion into a flange slot of the panel engaging portion.

* * * * *